US007931218B2

(12) United States Patent
Anderson et al.

(10) Patent No.: US 7,931,218 B2
(45) Date of Patent: Apr. 26, 2011

(54) METHOD FOR INCREASING EFFICIENCY OF GRINDING OF ORES, MINERALS AND CONCENTRATES

(75) Inventors: Gregory Stephen Anderson, Queensland (AU); Daniel Charles Curry, Queensland (AU); Joseph Damian Pease, Queensland (AU)

(73) Assignee: Xstrata Technology Pty Ltd, Brisbane (AU)

( * ) Notice: Subject to any disclaimer, the term of this patent is extended or adjusted under 35 U.S.C. 154(b) by 456 days.

(21) Appl. No.: 11/990,429

(22) PCT Filed: Aug. 8, 2006

(86) PCT No.: PCT/AU2006/001125

§ 371 (c)(1),
(2), (4) Date: Nov. 25, 2008

(87) PCT Pub. No.: WO2007/019602

PCT Pub. Date: Feb. 22, 2007

(65) Prior Publication Data

US 2009/0188998 A1 Jul. 30, 2009

(30) Foreign Application Priority Data

Aug. 15, 2005 (AU) ..... 2005904395

(51) Int. Cl.
*B02C 1/00* (2006.01)

(52) U.S. Cl. ..... 241/21; 241/30; 241/172; 241/184

(58) Field of Classification Search ..... 241/21, 241/30, 172, 184
See application file for complete search history.

(56) References Cited

U.S. PATENT DOCUMENTS

| | | | | |
|---|---|---|---|---|
| 5,085,889 | A | 2/1992 | Platz et al. | |
| 5,407,140 | A * | 4/1995 | Lofthouse et al. | 241/21 |
| 5,513,806 | A * | 5/1996 | Falcon-Steward | 241/21 |
| 5,797,550 | A | 8/1998 | Woodall et al. | |
| 5,984,213 | A | 11/1999 | Woodall et al. | |
| 7,431,830 | B2 * | 10/2008 | Cleminson et al. | 208/390 |

FOREIGN PATENT DOCUMENTS

WO WO 2002/068333 9/2002

OTHER PUBLICATIONS

Derwent Abstract Accession No. 2004-056307/06, Class A60 E33 JP 2003-305378 A (Kyoritsu Yogyo Genryo KK) Oct. 28, 2003.

* cited by examiner

*Primary Examiner* — Bena Miller
(74) *Attorney, Agent, or Firm* — Welsh Flaxman & Gitler LLC

(57) ABSTRACT

A method for reducing particle size of a particulate comprising feeding a feed material to a grinding mill having a power of at least 500 kW, the mill having a specific power draw of at least 50 kW per cubic meter of grinding volume of the mill and the grinding mill including a grinding media comprising particulate material having a specific gravity of not less than 2.4 tons/m3 and a particle size falling in the range of from about 0.8 to 8 mm, grinding the feed material in the grinding mill and removing a product from the grinding mill, the product having a particle size range such that D80 of the product is at least about 20 microns.

28 Claims, 5 Drawing Sheets

METHOD FOR INCREASING EFFICIENCY OF GRINDING OF ORES, MINERALS AND CONCENTRATES

FIELD OF THE INVENTION

The present invention relates to an improved grinding process for the comminution of a particulate feed material or a particulate feed stream. The present invention is particularly useful for size reduction of particulate material in the mining or mineral industries and especially for the size reduction of an ore, a concentrate or a carbonaceous material, such as coal.

BACKGROUND TO THE INVENTION

Size reduction, or comminution of particulate materials is commonly practiced in the mining and mineral industries. For example, beneficiation of ores from a mine commonly require that the ore be subject to comminution in order to reduce the particle size of the ore and to expose the desired mineral faces for the beneficiation process. This is especially so in relation to flotation processes for producing concentrates from ores, for leaching of minerals from ores or concentrates, as well as physical separation processes such as gravity, electrostatic and magnetic separation. Similarly, a number of other mineral treatment processes require size reduction of an ore or concentrate in order to increase the kinetics of the mineral treatment process to economical rates.

Grinding is one frequently used method for size reduction or comminution of particulate materials. Grinding mills typically include a grinding chamber to which the particulate material is added. An outer shell of the grinding chamber may be rotated, or an internal mechanism in the grinding chamber may be rotated (or both). This causes stirring or agitation of the particulate material in the grinding chamber. A grinding medium may also be added to the grinding chamber. If the grinding medium is different to the particulate material being subjected to comminution, the grinding method is referred to exogenous grinding. If collisions between the particulate material itself causes the grinding action and no other grinding medium is added, it is known as autogenous grinding. A wide variety of grinding mills are known including bead mills, peg mills, ball mills, rod mills, colloid mills, fluid energy mills, cascade mills, stirred mills, agitated mills, SAG mills, AG mills, tower mills and vibrated mills.

U.S. Pat. Nos. 5,797,550 and 5,984,213 (the entire contents of which are incorporated herein by cross-reference) describe a grinding mill or an attrition mill which includes an internal classification zone in the grinding chamber. The mills described in these U.S. patents may be vertical shaft mills or horizontal shaft mills. A commercial embodiment of the mills described in these United States patents is sold under the trade name "IsaMill" by Xstrata Technology, a business division of the applicants in respect of the present application.

The feed material fed to a grinding mill and the product material removed from a grinding mill will have a particle size distribution. There are a number of ways of characterizing the particle size distribution of particulate material. For example, a graphical representation as to the cumulative mass percent passing a nominal size versus the particle size may be used. The nomenclature $D_x$ is then used to denote the size at which weight percent, on a cumulative basis passes. For example, $D_{80}$ refers to a particulate size distribution where 80% (on a cumulative basis) passes the nominated size. Thus, $D_{80}$ equals 75 microns refers to a particulate size distribution in which 80% of the mass is finer than 75 microns.

IsaMill technology has been implemented to achieve ultrafine grinding of relatively fine feed particulate materials. The Isamill utilizes circular grinding discs that agitate the media and/or particles in a slurry. A classification and product separator keeps the grinding media inside the mill, allowing only the product to exit. Installations of IsaMills to date have used natural grinding media and directed to obtaining an ultrafine product having a $D_{80}$ of below 19 microns, and most commonly a $D_{80}$ of below 12 microns.

In grinding applications, the feed particulate material is typically referred to as F and the product particulate material is referred to as P. Thus, $F_{50}$ refers to a feed sample where 50% passes the nominated size. Similarly, $P_{98}$ equals 100 micrometers refers to a product size distribution where 98% of the mass is finer than 100 micrometers.

Size distribution curves in grinding applications, described as size versus cumulative percent passing on a log versus normal axis, are typically characterized by a single point on the curve, namely $D_{80}$ (or 80% cumulative mass passing size). The $P_{80}$ is a reasonable description of classical grinding and classification size distribution curves as the feed size distribution is progressively moved to the left on a log-linear scale as the particles are ground to finer sizes with traditional techniques.

BRIEF DESCRIPTION OF THE INVENTION

In a first aspect, the present invention provides a method for reducing particle size of a particulate containing feed comprising:

a) providing a particulate containing feed material;

b) feeding the feed material to a grinding mill having a power of at least 500 kW, the mill having a specific power draw of at least 50 kW per cubic meter of grinding volume of the mill (being the internal volume of the mill net of the volume of the shaft(s) and stirrer(s)), the grinding mill including a grinding media comprising particulate material having a specific gravity of not less than 2.4 tonnes/$m^3$ and a particle size falling in the range of from about 0.8 to 8 mm;

c) grinding the feed material in the grinding mill; and d) removing a product from the grinding mill, the product having a particle size range such that $D_{80}$ of the product is at least about 20 microns.

Preferably, the product removed from the grinding mill has a particle size range such that $D_{80}$ of the product is from about 20 to 1000 microns.

Preferably, the grinding media is a man-made grinding media. Examples of man-made grinding media that may be used in the present invention include ceramic grinding media, steel or iron grinding media or grinding media based upon metallurgical slags. By "man-made grinding media", it is meant that the grinding media has been manufactured by a process that includes a chemical transformation of a material or materials into another material. The term "man-made grinding media" is not meant to encompass materials that have been treated solely by physical means, such as tumbling or screening of natural sands.

The grinding media may have a specific gravity that falls within the range of 2.2 to 8.5 tonnes per cubic meter.

In some embodiments, the method of the present invention utilises a ceramic grinding media. The specific gravity of the ceramic grinding media preferably falls within the range of 2.4 to 6.0 tonnes per cubic meter. More preferably, the specific gravity of the grinding media is greater than 3.0 tonnes per cubic meter, even more preferably about 3.2 to 4.0 tonnes per cubic meter, yet even more preferably about 3.5 to 3.7 tonnes per cubic meter.

The ceramic grinding media may comprise an oxide material. The oxide material may include one or more of alumina, silica, iron oxide, zirconia, magnesia, calcium oxide, magnesia stabilized zirconia, yttrium oxide, silicon nitrides, zircon, yttria stabilized zirconia, cerium stabilized zirconia oxide or other similar hard wearing materials.

The ceramic grinding media is preferably generally spherical in shape although other shapes may also be used. Even irregular shapes may be used.

In other embodiments, the present invention utilises iron or steel grinding media. In these embodiments, the grinding media is suitably in the form of spheres or balls, although other shapes may also be used. The specific gravity of steel or iron grinding media normally is greater than 6.0 tonnes/$m^3$, more preferably about 6.5 to 8.5 tonnes/$m^3$.

Other embodiments of the present invention utilise metallurgical slag as the grinding media. The metallurgical slag may be used in the form of irregular shaped particles of slag or, more preferably, as regular shaped particles of slag. If regular shaped particles of slag are used, those particles of slag are suitably of generally spherical shape. However, it will be understood that the present invention also extends to using other shapes.

The grinding media may be added to the grinding chamber such that it occupies from 60% to 90% by volume of the space within the grinding chamber, or even from 70 to 80% by volume of the space within the grinding chamber. However, it will be appreciated that the present invention also encompasses a grinding method in which the grinding mill has a volumetric filling of less than 60% of grinding media.

In one embodiment, the method of the present invention utilises a horizontal shaft grinding mill. Examples of a suitable horizontal shaft grinding mill is a horizontal shaft grinding mill as described in some embodiments of U.S. Pat. No. 5,797,550, or such as a horizontal shaft grinding mill as manufactured and sold by Xstrata Technology under the trade name IsaMill. Other horizontal shaft grinding mills or modified IsaMills may also be used.

The feed material added to the grinding mill may have a particle size range such that the $D_{80}$ of the feed material is from 30 to 3000 microns, more suitably from 40 to 900 microns, The product recovered from the method of the present invention has a $D_{80}$ from 20 to 700 microns. More preferably, the product has a $D_{80}$ from 20 to 500 microns.

The grinding method of the present invention typically utilises high power intensity and thus the method may be characterised as a high intensity grinding method. For example, the power draw with respect to the volume of the mill (being the internal volume of the mill net of the volume of the shaft(s) and stirrer(s)) falls within the range of 50 to 600 kW per cubic meter, more preferably 80 to 500 kW per cubic meter, even more preferably 100 to 500 kW per cubic meter.

The mill has a power of at least 500 kW. More suitably, the mill has a power of at least 750 kW. Even more suitably, the mill has a power of 1 MW or greater. Preferably, the mill has a power from 1 MW to 20 MW. In this regard, the power of the mill is determined by the power draw of the motor or motors powering the mill.

In preferred embodiments of the present invention, the grinding mill comprises an IsaMill (as described above). In the IsaMill, a series of stirrers are positioned inside the grinding chamber and these stirrers are rotated by an appropriate driven shaft. The high power intensity is achieved through a combination of high stirrer speed and compression of the media arising from back pressure applied in the grinding mill. Suitably, the tip speed of the rotating stirrers falls within the range of 5 to 35 meters per second, more preferably 10 to 30 meters per second, even more preferably 15 to 25 meters per second.

The stirrers used in an IsaMill are typically discs. However, it will be appreciated that an IsaMill may be modified to use different stirrers and the present invention encompasses use of such modified mills. It will also be appreciated that other stirred mills may also be used in accordance with the present invention where those other stirred mills incorporate appropriate rotating structures, for example, peg mills, mills that are stirred by a rotating auger flight, etc. The tip speed of those rotating apparatus preferably falls within the ranges given above.

It has been found that the grinding method of at least preferred embodiments of the present invention increases the energy efficiency of grinding to non ultrafine sizes compared with the rotating or stirred mills conventionally used for this duty in the mining and mineral industries The feed material is suitably fed to the grinding mill in the form of a slurry. Thus, in a preferred embodiment, the grinding method of the present invention is a wet grinding method.

Embodiments of the present invention provide a high intensity grinding process for use in the mining or minerals industries. The method uses large mills having high power draw, high specific power input and utilises man made grinding media. The method achieves grinding that is somewhat coarser than ultrafine grinding, thus making the method applicable to a large number of ores, concentrates or other materials. Previously, high intensity grinding has not obtained product in the size range obtained by the present invention, particularly when large size mills have been used.

DETAILED DESCRIPTION OF THE DRAWINGS

It will be appreciated that the following description relates to preferred embodiments of the present invention. Thus, it will be understood that the present invention should not be considered to be limited to the preferred embodiments described hereunder.

The method of the present invention is suitably conducted in a horizontal mill, such as horizontal shaft stirred mill. A horizontal shaft IsaMill is particularly suitable in this regard but it will be understood that other preferred embodiments of the present invention may be conducted in other horizontal or vertical shaft grinding mills. Using a grinding mill having a horizontal configuration provides the following advantages:

- it avoids short circuiting of feed solids, which assists in producing a narrow particle size distribution;
- it makes the process robust against changes in feed pulp density; and
- it reduces the height of installation and eases maintenance, mainly because the stirrer can be maintained without removing the gear box and/or shaft.

U.S. Pat. No. 5,797,550, particularly FIGS. 6, 20, 21 and 22 describe embodiments of suitable horizontal shaft grinding mills suitable for use in the present invention.

Figure 1:
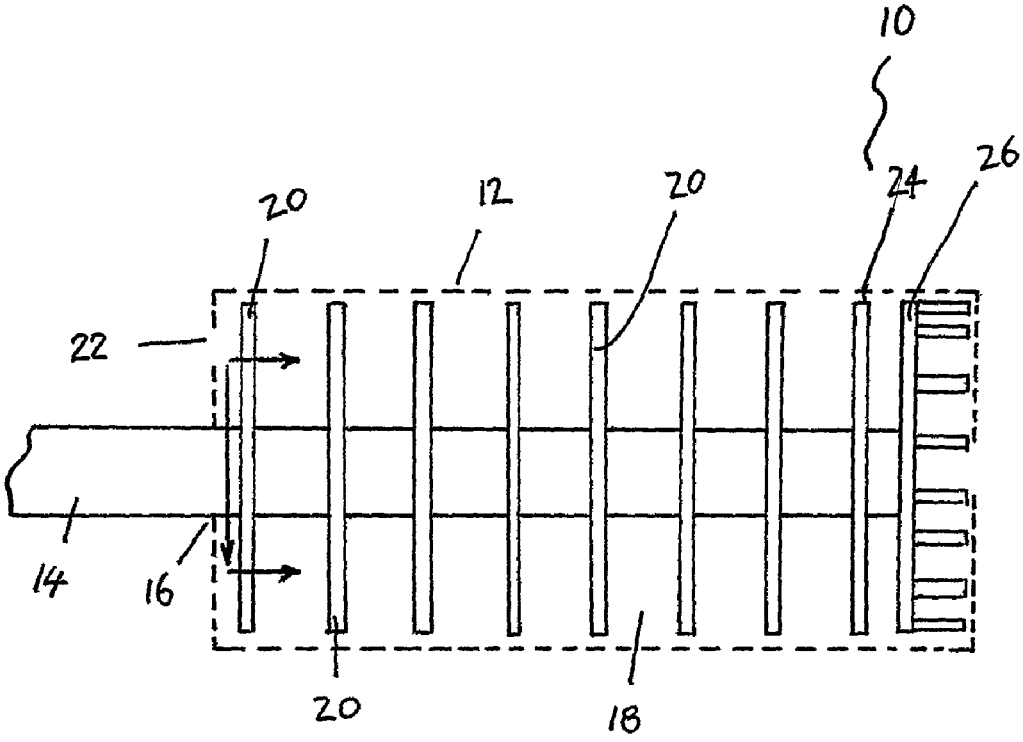
FIG. 1 shows a schematic cross-sectional view of a grinding mill suitable for use in the method of the present invention.

FIG. 1 of the present application shows a schematic view of a grinding mill suitable for use in the present invention. The mill 10 of FIG. 1 comprises an outer shell 12. A drive shaft 14 extends through a sealing mechanism 16 into the grinding chamber 18. The drive shaft 14 carries a plurality of spaced grinding discs 20. The grinding discs 20 are arranged such that they rotate with the drive shaft 14. The drive shaft 14 is driven by a motor and gear box arrangement (not shown), as will be well understood by persons skilled in the art.

The feed pulp and make up media are fed to the grinding mill 10 via inlet 22. The feed particulate material and grinding media interact with the rotating discs 20. The discs are spaced to agitate the media in a high shear pattern to cause grinding of the particulate material. Each of the grinding discs 20 is provided with a plurality of openings through which the particulate material passes as it traverses along the axial extent of the grinding mill 10.

The mill is also provided with a classification disc 24 and a separation rotor 26. These are designed to operate in accordance with the classification discs and separation rotors in U.S. Pat. No. 5,797,550. In particular, the classification disc 24 is placed close to the separation rotor 26 so that media is not recirculated during agitation but is rather centrifuged towards the grinding chamber shell 12. The separation rotor 26 pumps a large recirculating flow against the direction of pulp flow in the mill. This action holds the centrifuged media away from the discharge area of the mill. The large particles (grinding media and coarse feed) are affected by these forces and are retained inside the mill. Fine particles (being the product size particles and eroded or abraded media that has passed its useful grinding media life) are not affected by the centripetal forces acting between the classification disc 24 and the separation rotor 26 and exit the mill via a cylindrical distributor.

The amount of pulp pumped or recirculated by the separation rotor 26 affects the mill feed pump pressure and compressive forces on the grinding media increasing the volumetric rate of the rotor is achieved by changing the mill rotational speed and/or the rotor design. An increase in pumping rate of the separation rotor will increase the power draw of the mill, all other factors being equal. High separation rotor pumping rates are desirable in the method of the present invention to counteract the high volumetric throughput of fresh feed pulp.

Figure 2:
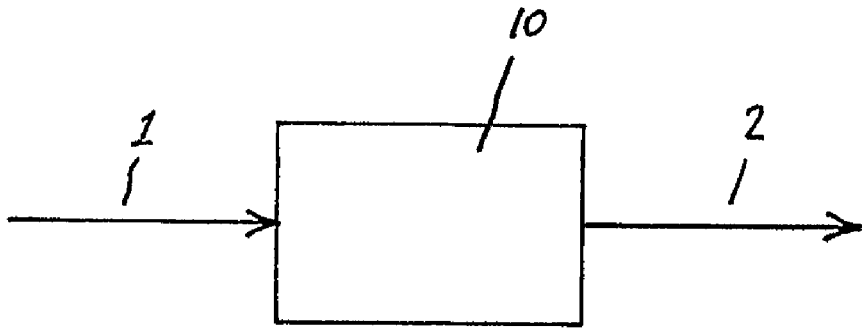
FIG. 2 shows a flow sheet of an open circuit grinding circuit for use in a preferred embodiment of the present invention.

FIG. 2 shows a preferred grinding flow sheet for use with the present invention. In particular, FIG. 2 shows an open circuit grinding circuit in which feed 1 is fed to grinding mill 10 and product 2 removed from the grinding mill 10. No recirculation of product takes place. This flowsheet is preferred where the grinding mill is an IsaMill because the IsaMill allows for internal classification of the product.

Figure 3:
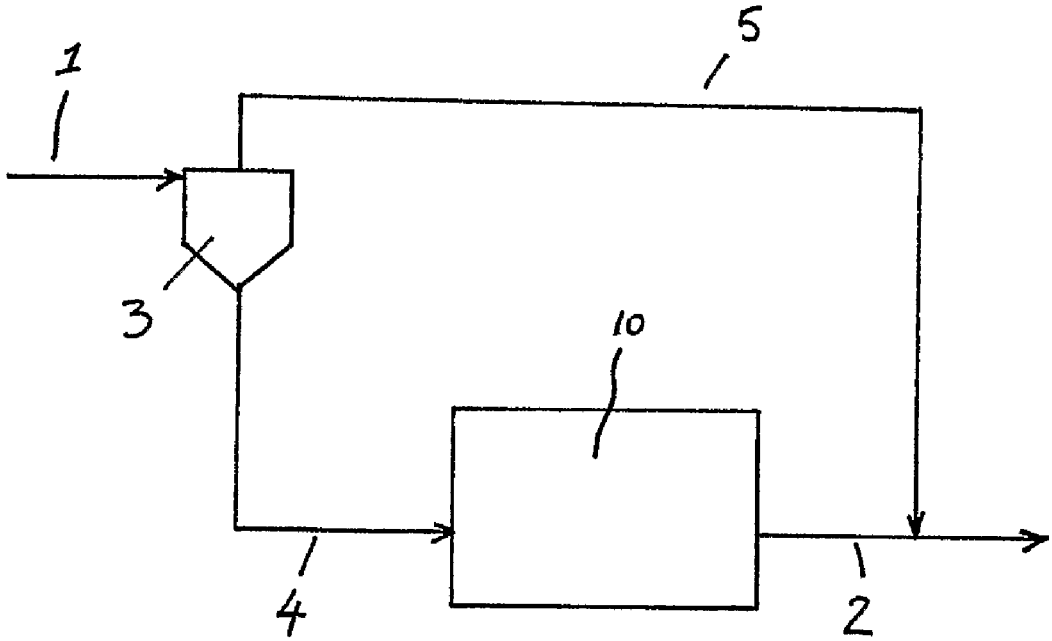
FIG. 3 shows a flow sheet of a grinding circuit utilises densification of feed.

FIG. 3 shows an alternative grinding circuit configuration in which the feed 1 is subjected to densification and/or particle classification in a cyclone 3, however other techniques can be used, including but not limited to, thickeners or clarifiers. The coarse material 4 is fed to the grinding mill 10 whilst the fines 5 pass the grinding mill 10 and are mixed with the product 2 from the grinding mill 10.

Figure 4:
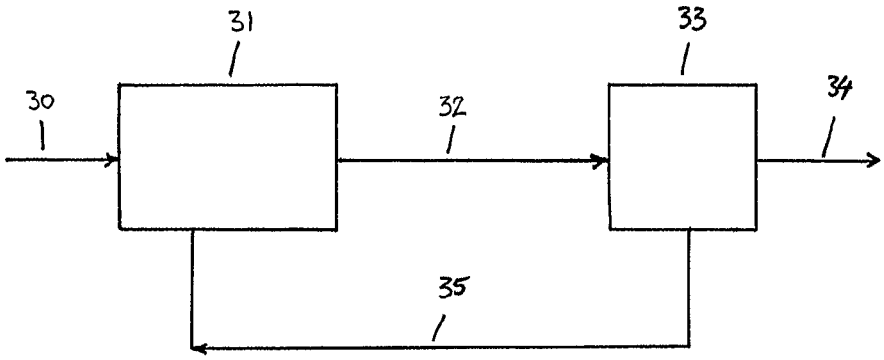
FIG. 4 shows a flowsheet of a grinding circuit that uses external classification of the product.

FIG. 4 shows a further grinding flowsheet in accordance with a further embodiment of the present invention. The flowsheet shown in FIG. 4 has a feed material 30 fed to a grinding mill 31. Grinding mill 31 may not need an internal classifier such that the particulate material 32 leaving mill 31 is not classified. Particulate material 32 is passed to a classifier 33 where it is classified into a product stream 34 and a recycle stream 35 that is returned to the mill 31 for further grinding. Classifier 33 may include a cyclone, hydrocyclone, one or more screens or any other suitable classifying means known to be suitable to the skilled person.

Open circuit operation, as shown in FIG. 2, is preferred in cases where an IsaMill, as described in U.S. Pat. Nos. 5,797,550 and 5,984,213, is used, as such mills include an internal classification mechanism that is capable of producing a mill product particle size distribution that is very narrow and ideal for further processing. Closing the circuit with a classifier (i.e. a cyclone or hydro-cyclone) may produce a wider product size distribution. The flow sheet of FIG. 3 is suitable where it is desired to minimise the amount of material passing through the grinding mill. The flow sheet of FIG. 4 is more suitable where the mill has no internal classification or an internal classification that does not produce a narrow product particle size distribution.

In order to demonstrate the method of the present invention, a feed particle size distribution was subjected to grinding in accordance with the present invention. The test run was operated under the following conditions:

- open circuit configuration;
- horizontal shaft mill (IsaMill);
- grinding media was 3.5 mm ceramic of specific gravity=3.6 t/m$^3$; and
- 500 kW/m$^3$ power intensity.

Figure 5:
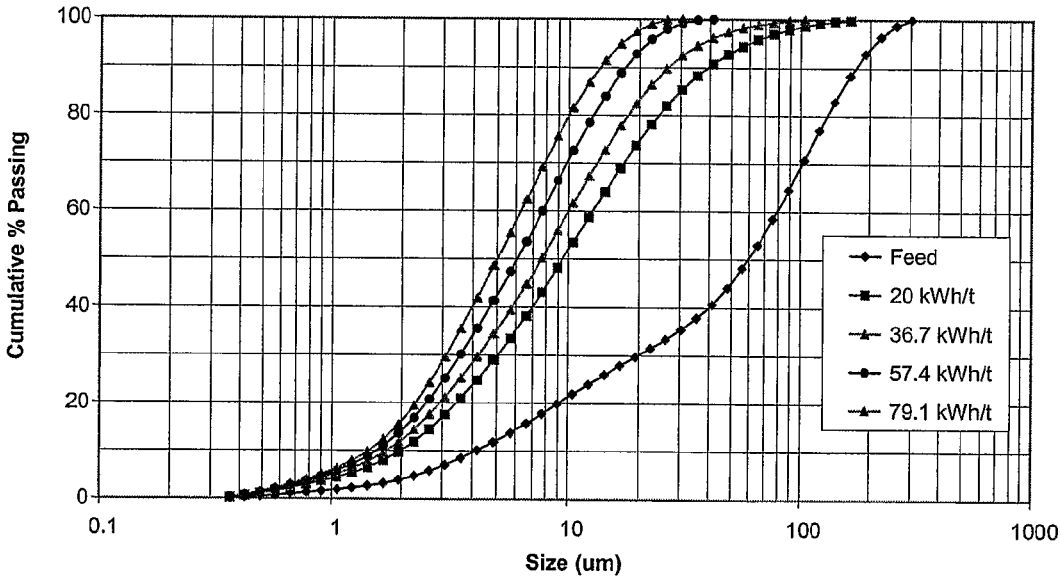
FIG. 5 shows a graph of cumulative percent passing a size vs size for an example of a grinding method in accordance with an embodiment of the present invention.

FIG. 5 shows the size distribution curves for the feed used in this example and the product obtained from the example.

From reviewing FIG. 5, it can be stated that grinding energy is preferentially directed to the coarse particles which require grinding and the generation of excess ultra fines is avoided. Further, a narrowing or sharpening of the product size distribution is occurring as the grinding continues the cumulative percent passing versus size curves are getting "steeper".

Figure 6:
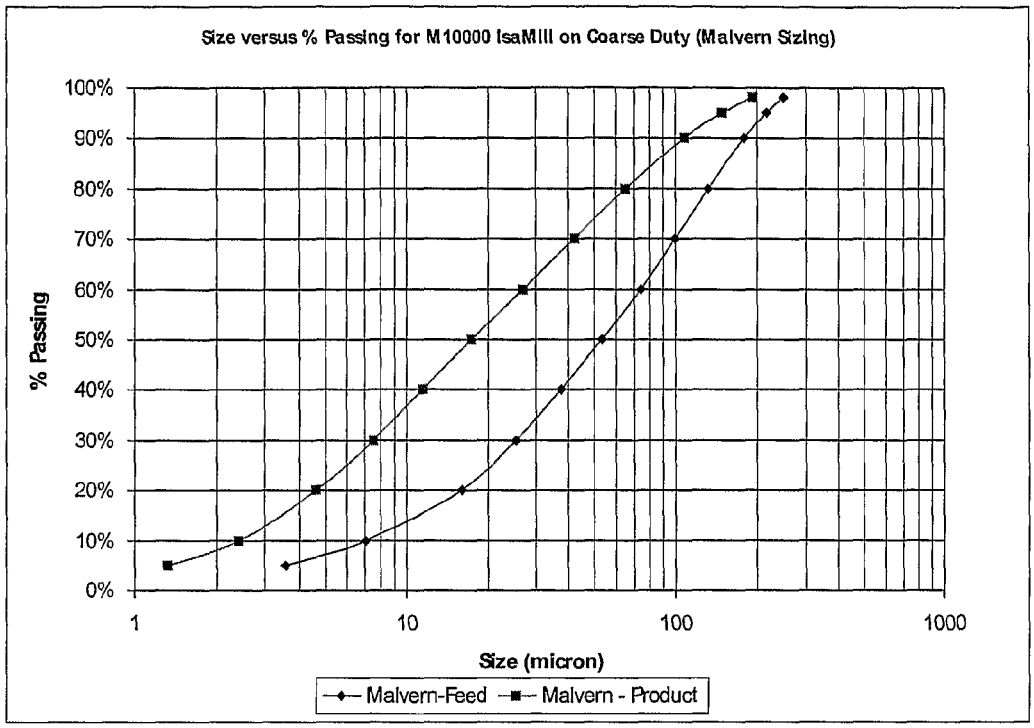
FIG. 6 shows a graph of cumulative percent passing a size vs size for an example of a grinding method in accordance with an embodiment of the present invention.

In FIG. 6, it can be seen an example of a full scale installation treating coarse product. In this case the power draw of the motor was 1.8 MW, while the grinding chamber was 10 m$^3$, with and a blended charge of 33% 2.5 mm ceramic media, with the remainder a mixture of 3 mm to 3.5 mm ceramic media. While the mill was operated unoptimised and in open circuit, without utilising the full power draw of 2.6 MW, it could be demonstrated that the mill could treat coarse feed. The feed to the mill had a $F_{80}$ of 135 um and a $F_{50}$ of 60 um, and the discharge produced $P_{80}$ was 60 um, and a $P_{50}$ of 17 um. It could be noted from FIG. 6 that for fine sizes the distribution was steeper than the feed, while the coarser size ranges had a lesser gradient than the feed distribution.

In some embodiments of the present invention, the method allows for increased throughput for the same energy consumption. Alternatively, for new grinding installations, reduced capital costs can be incurred because throughput requirements can be met with a mill that is smaller than would otherwise be required. The method of the present invention also provides increased grinding efficiency when compared to other grinding processes, thereby providing reduced operating costs. The method of the present invention utilises large grinding mills to obtain enhanced grinding efficiency, which allows for larger throughput for a given grinding installation or reduced capital costs for a new grinding installation. The method is used for grinding in the mining or mineral fields. The method may be used to prepare feed streams for leaching, flotation, gravity separation, magnetic separation, electrostatic separation, coal streams suitable for washing, production of coal-water fuel slurry or coal gasification, feed streams for sintering or smelting, alumina and bauxite processing, iron ore processing including magnetite, taconite and haematite, pellet production and the like, as well as being used in conjunction with High Pressure Grinding Roll circuits. The method also allows for the treatment of feed materials having a particle size distribution that was previously thought to be unsuitable for grinding by large scale, high intensity grinding mills and to obtain a non-ultrafine product size distribution.

Figure 7:
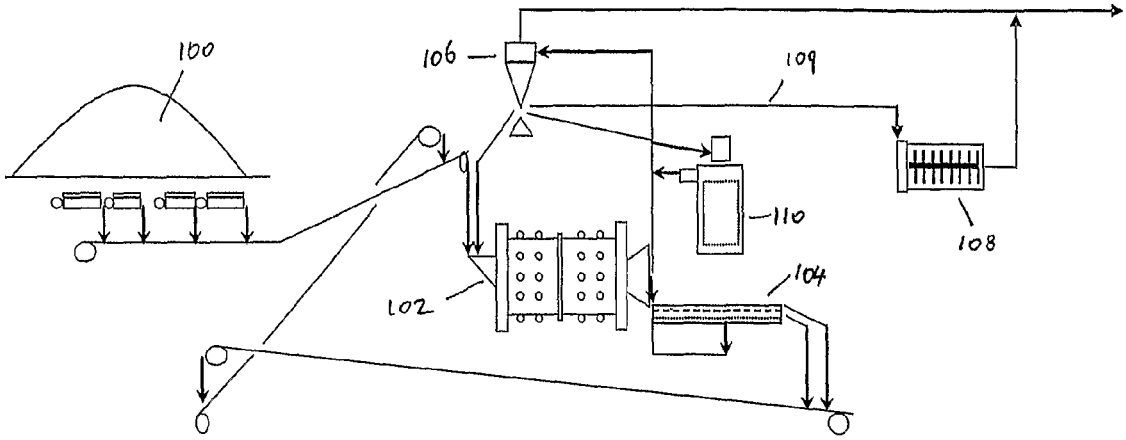
FIG. 7 shows a flowsheet incorporating an example of the present invention.

FIG. 7 shows a flowsheet incorporating an IsaMill operated in open circuit for grinding a SAG mill cyclone underflow to produce a product suitable for flotation. In the flowsheet of FIG. 7, ore from an ore stockpile 100 is fed to a SAG mill 102. The product from SAG mill 102 is screened on screen 104. Oversize product captured by screen 104 is returned to the SAG mill 102.

Particles passing through the screen 104 are sent to primary cyclones 106. Cyclone underflow is sent to IsaMill 108. Product from IsaMill 108 is sent to the flotation plant. In the normal plant, cyclone underflow is fed to Tower mill 110 and thereafter returned to the primary cyclone feed.

For the purposes of the testwork, IsaMill 108 was an M20 IsaMill. The M20 IsaMill is a small scale mill that is used for testwork purposes, with the results from the mill being able to be used for full scale design of large scale IsaMills, such as the M10000.

A bleed stream 109 from the cyclone underflow was passed through a magnetic separator and then screened over a 1.04 mm screen before it entered the M20 IsaMill to ensure that the remnants of the SAG mill media, steel scats, did not block the mill. The M20 IsaMill, has a 20 L grinding chamber and approximately 15 L of media was added to the grinding chamber. The media was Magotteaux MT1 (Keramax), and consisted of 50% 2.5 mm and 50% 3.5 mm media. The SG of the pulp was between 1.23 to 1.39. Feed to the mill was 0.9 $m^3$/hr.

Figure 8:
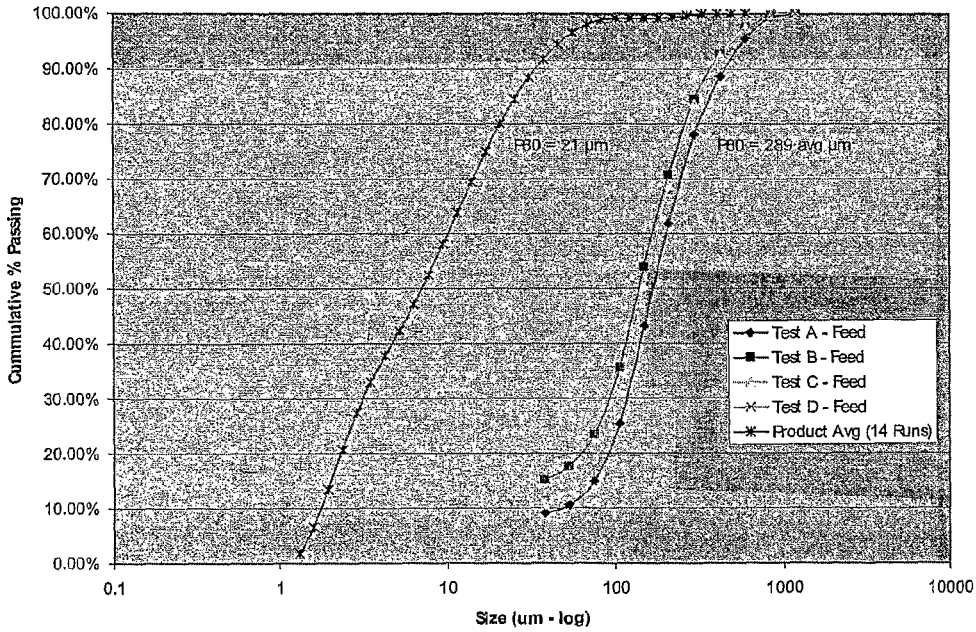
FIG. 8 shows a graph of cumulative percentage passing a size vs size for an example of a grinding method in accordance with an embodiment of the present invention.

On average, the coarse feed from the screened cyclone underflow had a $F_{80}$ between 250 to 300 um, while the product from the IsaMill had a $P_{80}$ that varied between 20 to 30 um. The results of one day of results are shown in FIG. 8.

Those skilled in the art will appreciate that the present invention may be susceptible to variations and modifications other than those specifically described. It will be understood that the present invention encompasses all such variations and modifications that fall within its spirit and scope.

The invention claimed is:

1. A method for reducing particle size of a particulate containing feed comprising:

a) providing a particulate containing feed material;

b) feeding the feed material to a grinding mill having a power of at least 500 kW, the mill having a specific power draw of at least 50 kW per cubic meter of grinding volume of the mill (being the internal volume of the mill net of the volume of the shaft(s) and stirrer(s)), the grinding mill including a grinding media comprising particulate material having a specific gravity of not less than 2.4 tonnes/$m^3$ and a particle size falling in the range of from about 0.8 to 8 mm;

c) grinding the feed material in the grinding mill; and d) removing a product from the grinding mill, the product having a particle size range such that $D_{80}$ of the product is at least about 20 microns.

2. A method as claimed in claim 1 wherein the product removed from the grinding mill has a particle size range such that $D_{80}$ of the product is from about 20 to 1000 microns.

3. A method as claimed in claim 1 wherein the grinding media is a man-made grinding media that has been manufactured by a process that includes a chemical transformation of a material or materials into another material.

4. A method as claimed in claim 3 wherein the man-made grinding media comprises ceramic grinding media, steel or iron grinding media or grinding media based upon metallurgical slags.

5. A method as claimed in claim 1 wherein the grinding media has a specific gravity that falls within the range of 2.2 to 8.5 tonnes per cubic meter.

6. A method as claimed in claim 1 wherein the grinding media comprises a ceramic grinding media.

7. A method as claimed in claim 6 wherein the specific gravity of the ceramic grinding media falls within the range of 2.4 to 6.0 tonnes per cubic meter.

8. A method as claimed in claim 7 wherein the specific gravity of the grinding media is greater than 3.0 tonnes per cubic meter.

9. A method as claimed in claim 8 wherein the specific gravity of the grinding media is from about 3.2 to 4.0 tonnes per cubic meter.

10. A method as claimed in claim 9 wherein the specific gravity of the grinding media is from about 3.5 to 3.7 tonnes per cubic meter.

11. A method as claimed in claim 6 wherein the ceramic grinding media comprises an oxide material.

12. A method as claimed in claim 11 wherein the oxide material is selected from the group consisting of alumina, silica, iron oxide, zirconia, magnesia, calcium oxide, magnesia stabilized zirconia, yttrium oxide, silicon nitrides, zircon, yttria stabilized zirconia, cerium stabilized zirconia oxide or mixtures thereof.

13. A method as claimed in claim 1 wherein the grinding media is iron or steel grinding media.

14. A method as claimed in claim 1 wherein the grinding media is a metallurgical slag grinding media.

15. A method as claimed in claim 1 wherein the grinding media is added to the grinding chamber such that it occupies from 60% to 90% by volume of the space within the grinding chamber.

16. A method as claimed in claim 1 wherein the grinding mill comprises a horizontal shaft grinding mill.

17. A method as claimed in claim 1 wherein the feed material added to the grinding mill has a particle size range such that $D_{80}$ of the feed material is from 30 to 3000 microns.

18. A method as claimed in claim 17 wherein the $D_{80}$ of the feed material is from 40 to 900 microns.

19. A method as claimed in claim 1 wherein the product recovered from the method has a $D_{80}$ from 20 to 700 microns.

20. A method as claimed in claim 19 wherein the product has a $D_{80}$ from 20 to 500 microns.

21. A method as claimed in claim 1 wherein the power draw with respect to the volume of the mill falls within the range of 50 to 600 kW per cubic meter.

22. A method as claimed in claim 21 wherein the power draw falls within the range of 80 to 500 kW per cubic meter.

23. A method as claimed in claim 21 wherein the power draw falls within the range of 100 to 500 kW per cubic meter.

24. A method as claimed in claim 1 wherein the mill has a power of at least 750 kW.

25. A method as claimed in claim 24 wherein the mill has a power of 1 MW or greater.

26. A method as claimed in claim 24 wherein the mill has a power from 1 MW to 20 MW.

27. A method as claimed in claim 1 wherein the mill comprises a horizontal shaft mill having a series of stirrers positioned inside the grinding chamber, the stirrers being rotated by a driven shaft, the stirrers being rotated such that a tip speed of the stirrers falls within the range of 5 to 35 meters per second.

28. A method as claimed in claim 1 wherein the feed material is suitably fed to the grinding mill in the form of a slurry.

* * * * *